United States Patent [19]

Schasteen et al.

[11] Patent Number: 4,909,741

[45] Date of Patent: Mar. 20, 1990

[54] WELLBORE TOOL SWIVEL CONNECTOR

[75] Inventors: Thomas Schasteen, Garland; Lonnie J. Smith, Allen, both of Tex.

[73] Assignee: Atlantic Richfield Company, Los Angeles, Calif.

[21] Appl. No.: 335,400

[22] Filed: Apr. 10, 1989

[51] Int. Cl.[4] ..... H01R 39/08

[52] U.S. Cl. ..... 439/13

[58] Field of Search ..... 439/13, 17–24, 439/28

[56] References Cited

U.S. PATENT DOCUMENTS

| | | | |
|---|---|---|---|
| 2,889,531 | 6/1959 | Ellerman et al. | 439/20 |
| 3,195,094 | 7/1965 | Mohr | 439/17 |
| 3,360,762 | 12/1967 | Mohr | 439/17 |
| 4,488,139 | 12/1984 | Snider, Jr. | 439/23 |

FOREIGN PATENT DOCUMENTS

| | | | |
|---|---|---|---|
| 22138 | 10/1912 | United Kingdom | 439/17 |
| 2097204 | 10/1982 | United Kingdom | 439/19 |

*Primary Examiner*—Gary F. Paumen

*Attorney, Agent, or Firm*—Michael E. Martin

[57] ABSTRACT

A swivel connector for interconnecting a wireline cable with a logging tool includes an elongated tubular body member having a cavity for supporting one or more slipring assemblies. An elongated shaft is disposed partially in said body member and extends from a lower end thereof and is supported on rolling element bearings. The shaft is connected to the rotors of the slipring assemblies while the stator members of the slipring assemblies are held stationary in relation to the body member by an elongated axial key. Flexible electrical conductors from the wireline cable are connected to the stator and flexible conductors are connected to the slipring rotors and extend through an axial passage in the shaft toward a plug for connecting the conductors to the logging tool.

10 Claims, 1 Drawing Sheet

WELLBORE TOOL SWIVEL CONNECTOR

BACKGROUND OF THE INVENTION

1. Field of the Invention

The present invention pertains to a swivel connector for interconnecting a multiconductor wireline cable or tubing string with a logging tool or similar downhole device for use in oil and gas well operations.

2. Background

In many oil and gas wellbores the well casing path is not perfectly vertical but descends in a somewhat helical manner due to the somewhat helical path that the drillbit has followed as the wellbore was being formed. This helical path of the well casing presents problems with the lowering of wellbore tools with wireline cables or tubing strings, particularly the type of tool which engages the casing walls such as logging tools which are centered in the casing by centralizers or guides. As these tools or similar devices are lowered into the wellbore a torque is exerted on the tool and the tubing string or wireline cable with respect to the wellbore axis which, if not alleviated, may damage the tubing or cable and/or the tool.

Accordingly, there has been a need for a type of connector between tubing or wireline cable and the wellbore tool which will allow rotation of the tool relative to the tubing or cable without imposing any torsional deflection thereon, but while still providing for electrical interconnection between the tool and the tubing or cable which is connected to recording or control apparatus either on the surface or uphole from the tool. The present invention provides a solution to this need as will be understood from the description which follows herein.

SUMMARY OF THE INVENTION

The present invention provides an improved connector for interconnecting wireline cables or tubing with subterranean well tools to minimize the imposition of torque or longitudinal twisting effort on the cable or tubing during operations with such tools. In accordance with an important aspect of the invention, there is provided a connector which includes a swivel mechanism to permit free rotation of a logging tool or the like with respect to a multiconductor wireline cable or tubing string to prevent longitudinal twisting of the cable or tubing and the resulting damage which may be incurred.

The swivel connector includes a readily accessible and rugged thrust bearing arrangement for transferring the weight of the tool or axial pulling forces exerted thereon to the tubing or cable and for receiving thrust loads in the opposite direction. The swivel connector of the present invention also includes plural slipring assemblies which are secured within the tool by a combination of elements which prevents rotation of the stator member of the slipring assemblies, but also provides for easy assembly and disassembly of the connector for servicing the slipring assemblies or changing the connections between conductor elements and the slipring assemblies. The swivel connector also includes a rugged central shaft member which is connected to one of the body portions of the connector which is adapted for rotation relative to the other body portion.

In accordance with yet another aspect of the present invention, there is provided a swivel connector particularly adapted for wellbore applications or applications in similar harsh, fluid filled environments which is configured to be easily sealed to prevent the incursion of fluids into a chamber which holds the slipring assemblies for transferring electrical signals between rotating members.

The above-described features and advantages of the present invention as well as other superior aspects thereof will be further appreciated by those skilled in the art upon reading the detailed description which follows in conjunction with the drawing.

BRIEF DESCRIPTION OF THE DRAWING

FIGS. IA and IB comprise a longitudinal central section view of the unique swivel connector of the present invention.

DESCRIPTION OF A PREFERRED EMBODIMENT

Figure 1A:
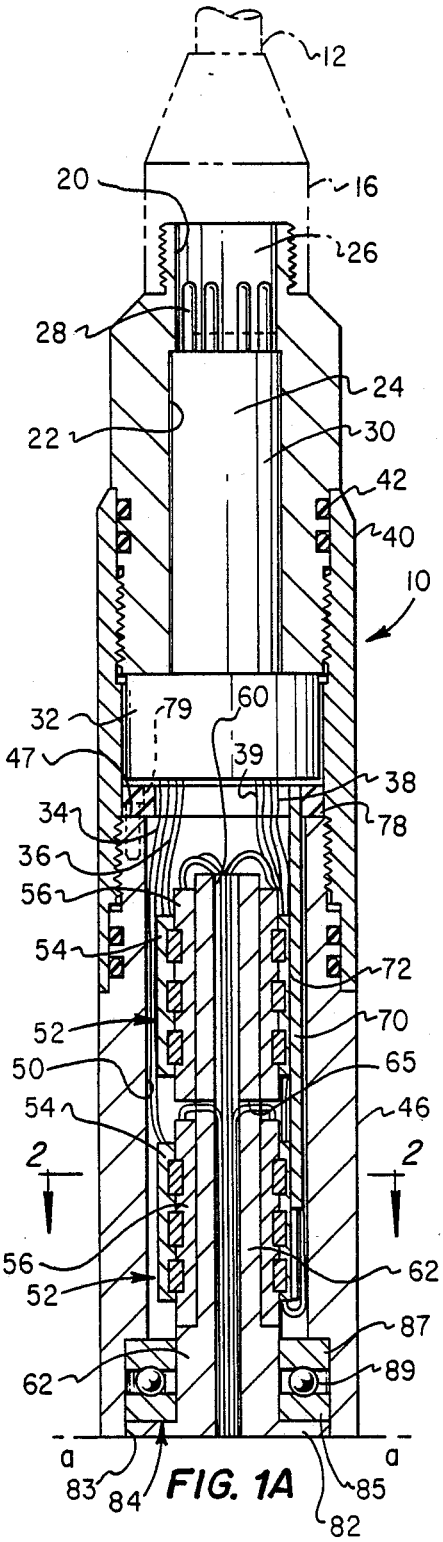

In the description which follows like parts are marked throughout the specification and drawing with same numerals, respectively. The drawing figures may be exaggerated in scale in the interest of clarity and conciseness. FIGS. IA and IB are intended to be read as one continuous view when joined at the line a—a.

Figure 1B:
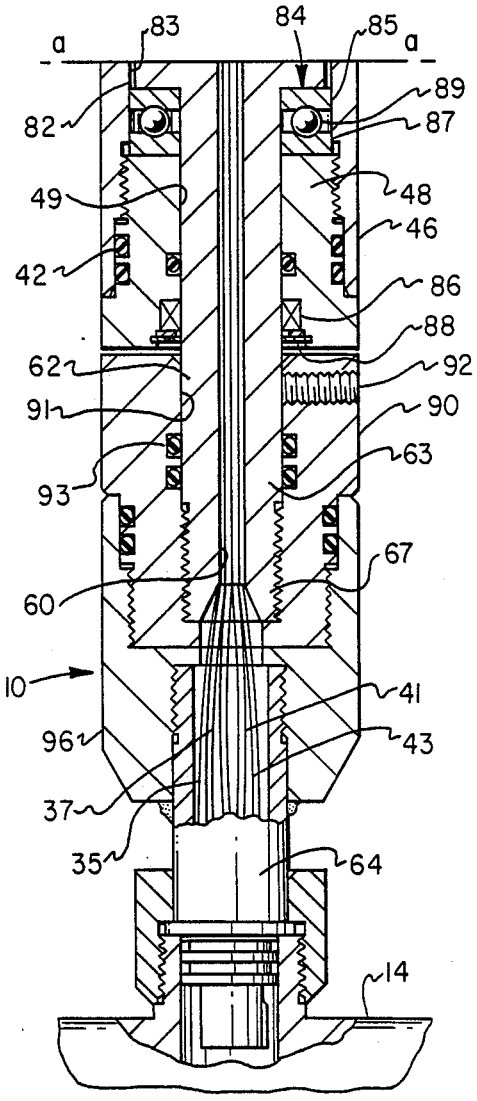

Referring to FIGS. 1A and 1B, in particular, there is illustrated a unique swivel connector in accordance with the present invention which is generally designated by the numeral 10. The connector 10 is adapted to interconnect an elongated flexible multiconductor cable 12, commonly referred to in the oil and gas industry as a "wireline," with a downhole tool such as a logging tool 14. The cable 12 is typically constructed to have a braided or wound wire sheath with a hollow core in which multiple insulated conductor wires are disposed for transmitting electrical signals between the logging tool 14 and surface instrumentation or control apparatus, not shown.

The cable 12 includes a conventional end coupling member 16 which is adapted to be threadedly connected to an upper head member 18 of the swivel connector 10. Alternatively, the cable 12 may be disposed in a tubing string, not shown, the distal end of which would be connected to the head 18. The head 18 includes a first cylindrical bore portion 20 which opens into an enlarged bore 22, both of which are at least partially occupied by an electrical plug member 24. The plug member 24 is adapted to be electrically coupled to a plug portion 26 of the coupling 16 and, in a preferred embodiment, the plug member 24 includes a plurality of electrical conductor terminal pins 28 which are supported by a body 30 of the plug member and are connected to flexible insulated electrical conductor wires which extend from a lower body portion 32 and are designated by the numerals 34, 36, 38 and 39. The number of conductor wires may vary considerably depending on the particular type of cable being used.

The upper head member 18 is threadedly coupled to an intermediate body sleeve 40 and is in sealing engagement therewith by suitable o-ring seals 42 which are disposed in conventional o-ring grooves formed in the head member 18. The intermediate sleeve 40 is also threadedly coupled to one end of a first swivel body member 46 and a second set of o-ring seals 42 is disposed in suitable grooves formed on the first body member 46. The body member 46 is of generally cylindrical configuration and is also threadedly coupled at its opposite end to a bearing retainer head 48. A third set of o-ring seals 42 is disposed in suitable grooves formed on the periphery of the retainer head 48.

The body member 46 includes a cylindrical bore 50 defining an interior cavity in which one or more electrical slipring assemblies 52 are disposed. The slipring assemblies 52 may be of a type commercially available from IEC Corp., San Antonio, Tex., for example. The slipring assemblies 52 each include a stator member 54 and a rotor member 56 which are adapted to rotate relative to each other and to include suitable slipring and wiper mechanisms for transmitting electrical signals from the conductors 34, 36, 38 and 39 to a second set of flexible, insulated electrical conductors 35, 37, 41 and 43, as shown by way of example. The conductors 35, 37, 41 and 43 are connected to the rotor members 56 of the respective slipring assemblies and are trained through a central longitudinal passage 60 formed in an elongated shaft member 62. The rotors 56 are sleeved over and supported on the shaft 62 for rotation therewith. The conductors 35, 37, 41 and 43 exit the lower end of the shaft 62 and enter a connector plug member 64 of a conventional type utilized for connecting wireline cables to downhole logging tools and the like. The connector 64 may be of a type commercially available from SIE Wireline Products, Fort Worth, Tex. At least some of the conductors 35, 37, 41 and 43, and so on, may enter the passage 60 in the shaft 62 through transverse passages 65 disposed intermediate the respective slipring assemblies 52. Others of the conductors interconnecting the sliprings 52 with the connector 64 may enter the passage 60 at its upper end as illustrated.

Figure 2:
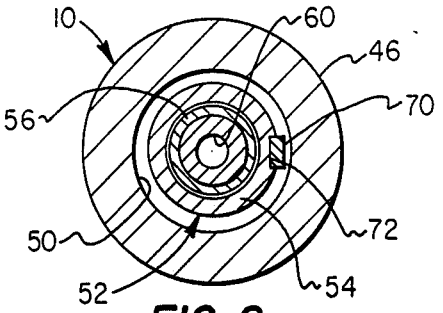
FIG. 2 is a section view taken along the line 2—2 of FIG. 1.

The stator members 54 of the respective slipring assemblies 52 are secured against rotation relative to the body member 46 by an elongated key member 70 which is disposed in respective longitudinal keyways 72, see FIG. 2, of the stator members 54. The key 70 is suitably secured to a support ring 78 which is disposed between the connector head portion 32 and an upper transverse end face 47 of the body member 46. In a preferred arrangement, the support ring 78 is secured to the body member 46 by suitable threaded fasteners 79, one shown.

The shaft 62 includes a transverse integral flange portion 82 formed intermediate opposed thrust bearings 84. The bearings 84 are disposed in a bore portion 83 of the body member 46 and also support the shaft 62 for rotation with respect to the body member. The thrust bearings 84 includes opposed races 85 and 87 between which are disposed rolling bearing elements 89. The shaft 62 also includes a lower extension part 63 which extends through a bore 49 in the retainer head 48 in relatively close fitting relationship thereto and is engaged with a suitable shaft seal 86 retained in a cavity in the retainer head 48 and secured therein by a removable retaining ring 88. The shaft part 63 is threaded at its distal end, as indicated at 65, and is threadedly coupled to a lower or second connector body member 90. A set screw 92 is threadedly disposed in the body member 90 and extends toward a central bore 91 formed for receiving the shaft portion 63. Suitable o-ring seals 93 are disposed in cooperating support grooves formed in the body member 90. The body member 90 is threadedly coupled to a lower end head member 96 which is secured to the connector 64 as illustrated to complete the assembly of the connector 10. Further o-ring seals 42 are disposed in suitable grooves formed in the body member 90 in the same manner as such o-ring seals are disposed on the members 18, 46 and 48.

Those skilled in the art will recognize from the foregoing description that an improved swivel connector is provided by the present invention which is adapted for taking relatively high thrust loads in both directions and including, particularly, forces of tools and other devices hanging from a wireline cable 12 while permitting relatively free rotation between the tool or device and the cable 12 without interfering with the conduction of electrical signals between the multiconductor cable and the tool. The tool 14 together with the second body member 90, the shaft 62 and the slipring rotors 56 rotate freely relative to the retainer head 48 and the body member 46 together with the members secured to the body member 46. The thrust bearings 84 may be of a type commercially available and sealed from exposure to the housing cavity in which the shaft 62 is disposed by suitable seals, not shown. The swivel connector 10 may be constructed of conventional engineering materials used for wellbore applications and may easily be disassembled and reassembled for servicing the slipring assemblies 52 and for changing the electrical connections between the conductors 34, 36, 38 and 39 and the slipring assemblies as well as the connections between the conductors 35, 37, 41 and 43 and the slipring assemblies.

Although a preferred embodiment of the invention has been described in detail herein, those skilled in the art will recognize that various modifications and substitutions may be made without departing from the scope and spirit of the invention as recited in the appended claims.

What is claimed is:

1. A swivel connector which provides electrical signals between a multiconductor wireline cable and a well logging tool while permitting relative rotation of said logging tool with respect to said cable, said connector comprising:

a first body member;

means connected to said first body member for connecting said connector to said cable;

means forming a cavity in said first body member, at least one slipring assembly disposed in said cavity having a rotor and a stator and first conductors interconnecting said stator and said cable;

an elongated shaft having a portion disposed in said cavity and supporting said rotor;

second conductors interconnecting said rotor with said logging tool;

bearing means disposed in said first body member and supporting said shaft for rotation of said shaft relative to said first body member; and means for retaining said bearing means in said first body member whereby by said shaft may rotate relative to said first body member while precluding the interruption of electrical signals between said logging tool and said cable.

2. The connector set forth in claim 1 wherein:

said shaft includes passage means therein for extension of said second conductors between said rotor and said logging tool.

3. The connector set forth in claim 1 including:

a second body member connected to a lower distal end of said shaft and means associated with said second body member connecting said connector to said logging tool.

4. The connector set forth in claim 1 wherein:

said bearing means comprises a first rolling element thrust bearing for supporting said logging tool at the distal end of said cable for free rotation relative to said cable.

5. The connector set forth in claim 4 wherein:

said bearing means comprises a second rolling element thrust bearing for supporting said shaft with respect to said first body member.

6. The connector set forth in claim 4 wherein:

said means for retaining said bearing means comprises a retainer head removably supported by said first body member 7. The connector set forth in claim 1 including:

means connected to said first body member and said stator for holding said stator against rotation relative to said first body member.

8. The connector set forth in claim 7 wherein:

said means for holding said stator comprises an elongated key engaged with said stator and connected to means for securing said key stationary relative to said first body member.

9. A swivel connector which provides electrical signals between a multiconductor wireline cable and a well logging tool while permitting relative rotation of said logging tool with respect to said cable, said connector comprising:

a first body member;

means connected to said first body member for connecting said connector to said cable;

means forming a cavity in said first body member, at least one slipring assembly disposed in said cavity having a rotor and a stator, and first conductors interconnecting said stator and said cable;

second conductors interconnecting said rotor with said logging tool;

an elongated shaft having a portion disposed in said cavity and supporting said rotor, said shaft including passage means therein for extension of said second conductors between said rotor and said logging tool;

bearing means disposed in said first body member and supporting said shaft for rotation of said shaft relative to said first body member;

a retainer head secured to said first body member for retaining said bearing means in said first body member whereby by said shaft may rotate relative to said first body member while precluding the interruption of electrical signals between said logging tool and said cable; and an elongated key engaged with said stator and connected to means for securing said key stationary relative to said first body member for holding said stator against rotation relative to said first body member.

10. A swivel connector which provides electrical signals between a multiconductor wireline cable and a well logging tool while permitting relative rotation of said logging tool with respect to said cable, said connector comprising:

a first generally cylindrical tubular body member;

means connected to said first body member for connecting said connector to said cable;

a connector plug in said means for connecting for interconnecting said cable with a set of plural first insulated conductors, said plug having plural electrical contacts therein;

means forming a cavity in said first body member, at least one slipring assembly disposed in said cavity having a rotor and a stator, said stator being connected to said first conductors;

an elongated shaft having a portion disposed in said cavity and supporting said rotor, said shaft including passage means therein;

plural second conductors connected to said rotor and extending within said passage means;

bearing means disposed in said first body member and supporting said shaft for rotation of said shaft relative to said first body member;

means for retaining said bearing means in said first body member whereby by said shaft may rotate relative to said first body member while precluding the interruption of electrical signals between said logging tool and said cable; and a second body member connected to one end of said shaft and including means for connecting said swivel connector to said logging tool.

* * * * *